US008739432B2

(12) United States Patent
Rydinsky

(10) Patent No.: US 8,739,432 B2
(45) Date of Patent: Jun. 3, 2014

(54) APPARATUS AND METHOD FOR DRYING SPORTS PADS AND APPAREL

(76) Inventor: Stephen N. Rydinsky, Jackson, NJ (US)

( * ) Notice: Subject to any disclaimer, the term of this patent is extended or adjusted under 35 U.S.C. 154(b) by 272 days.

(21) Appl. No.: 13/411,330

(22) Filed: Mar. 2, 2012

(65) Prior Publication Data

US 2012/0222327 A1 Sep. 6, 2012

Related U.S. Application Data

(60) Provisional application No. 61/448,721, filed on Mar. 3, 2011.

(51) Int. Cl.
*F26B 11/00* (2006.01)

(52) U.S. Cl.
USPC ... 34/289; 34/90; 34/104; 34/105; 211/86.01; 248/164; D32/58

(58) Field of Classification Search
USPC ..... 34/287, 289, 90, 97, 100, 104, 105; 211/1.55, 59.4, 86.01; 248/163.1, 164, 248/165, 166; D32/58, 59, 60
See application file for complete search history.

(56) References Cited

U.S. PATENT DOCUMENTS

| | | | | |
|---|---|---|---|---|
| 2,084,854 | A * | 6/1937 | McCarthy | 108/31 |
| 4,915,271 | A | 4/1990 | Champagne | |
| 5,199,188 | A * | 4/1993 | Franz | 34/105 |
| 5,287,636 | A * | 2/1994 | Lafleur et al. | 34/104 |
| 5,377,849 | A | 1/1995 | Martin | |
| 5,592,750 | A | 1/1997 | Eichten | |
| D394,926 | S * | 6/1998 | Lindsay | D32/58 |
| 5,778,556 | A * | 7/1998 | Ohsugi | 34/106 |
| 6,073,783 | A * | 6/2000 | Allman | 211/85.3 |
| 6,216,887 | B1 | 4/2001 | Soo | |
| 6,591,994 | B1 * | 7/2003 | Bearss | 211/85.7 |
| 6,880,711 | B2 * | 4/2005 | Collier | 211/85.7 |
| 7,025,215 | B2 * | 4/2006 | Bain et al. | 211/85.31 |
| 7,083,055 | B1 * | 8/2006 | Ambrosat | 211/85.7 |
| 7,103,989 | B2 * | 9/2006 | Rosseau et al. | 34/104 |
| 7,210,245 | B1 * | 5/2007 | Galli | 34/201 |
| 7,219,821 | B2 * | 5/2007 | Weal et al. | 223/85 |
| D616,621 | S * | 5/2010 | Prokop | D32/58 |

(Continued)

FOREIGN PATENT DOCUMENTS

| | | | | |
|---|---|---|---|---|
| CA | 002437470 | * | 7/2013 | |
| DE | 3412973 | A1 * | 10/1984 | A41D 13/00 |

(Continued)

OTHER PUBLICATIONS

Product Description, Shoe/Boot/Glove Dryer (YJ-CD002), http://www.made-in-china.com/showroom/yjgroupltd/product-detailqMiJigILXvVh/China-Shoe-Boot-Glove-Dryer-YJ-CD002-.html, Retrieved Feb. 28, 2012, 2 pages.

*Primary Examiner* — Steve M Gravini
(74) *Attorney, Agent, or Firm* — Moser Taboada

(57) ABSTRACT

A drying apparatus for drying sports pads or apparel is provided. The drying apparatus may include a first member and a second member. The first member may be aligned substantially perpendicular to the second member and slid into the second member to form the drying apparatus. The drying apparatus may be inserted into the sports pads or a portion of the apparel to permit air to flow throughout the innards of the sports pads or apparel, thereby facilitating the drying of the sports pads or apparel.

15 Claims, 8 Drawing Sheets

(56) References Cited

U.S. PATENT DOCUMENTS

| | | | | |
|---|---|---|---|---|
| 8,020,716 | B2 * | 9/2011 | Vitale | 211/197 |
| 8,393,482 | B2 * | 3/2013 | Durham | 211/85.7 |
| 2007/0113420 | A1 | 5/2007 | Hatt | |
| 2009/0100699 | A1 | 4/2009 | Hasler | |
| 2010/0122961 | A1 | 5/2010 | Moreau | |

FOREIGN PATENT DOCUMENTS

| | | | | |
|---|---|---|---|---|
| EP | 002654477 | * | 10/2013 | |
| GB | 2275326 | A | 8/1994 | |
| WO | WO 2005059231 | A1 * | 6/2005 | D06F 59/02 |

* cited by examiner

APPARATUS AND METHOD FOR DRYING SPORTS PADS AND APPAREL

CROSS-REFERENCE TO RELATED APPLICATIONS

This application claims the benefit of U.S. Provisional Application Ser. No. 61/448,721, filed Mar. 3, 2011, entitled "Apparatus for Drying Sports Pads," which is incorporated herein by reference in its entirety.

BACKGROUND

1. Field of the Invention

Embodiments of the present invention relate to an apparatus and method for drying apparel. More specifically, embodiments of the present invention relate to an apparatus and method for drying sports pads and apparel, such as a wetsuit.

2. Description of Related Art

Many contact sports, such as martial arts, boxing, wrestling, hockey, and/or football, involve varying degrees of contact between participants and other surfaces, such as the ground. Accordingly, contact sports often require protective sports pads to be positioned and located on various members of the body to protect the contact sports participant from such contact. Some example sports pads include elbow pads, forearm pads, hand pads, knee pads and the like. While participating in contact sports, participants often perspire while wearing sports pads. Accordingly, when in use, sports pads often become saturated with perspiration, and if used outdoors, dirt and other moisture (e.g. rain, water).

In addition to the sports pads, the apparel worn in many of the contact sports, as well as in other activities such as aquatic sports (e.g. surfing, scuba diving), may also get wet, whether through perspiration or as a result of the nature of the sport.

Oftentimes, it would be desirable to wash and dry the sports pads or apparel prior to the next use, which in many situations could be the very next day. Wetsuits in particular are usually washed or rinsed immediately after use to cleanse them of salt water, which can cause the wetsuit material to lose its flexibility. However, many of these sports pads and apparel cannot be washed and dried using conventional methods and apparatuses, such as a washing machine and dryer. This is because using a washing machine and/or dryer to wash and/or dry such pads and apparel generally causes deterioration of the material. Therefore, the pads and apparel must be washed and dried some other way.

One method of drying sports pads is to place the sports pads on a surface to allow them to air-dry. This method is limited and ineffective, however, because it does not allow the sports pads to stay in an "open" position. That is, by placing the sports pads on a surface, portions of the sports pads typically collapse upon other portions of the sports pads forming a "closed" position, and thereby trapping the moisture in the fabric and padding. This is problematic because, over time, trapping moisture leads to growth of bacteria, and results in strong, unpleasant and generally irremovable odors. This may force the owner to replace the sports pads due to hygiene concerns and/or the embarrassment of the strong unpleasant odors.

Another limitation of simply placing sports pads on a surface to dry is that the sports pads will not dry quickly such that they may still be wet when the owner intends to use them again. This may lead to an unpleasant and possibly distracting experience for the wearer if he is forced to wear the sports pads in this wet condition.

For apparel, a method of drying the apparel, particularly a wetsuit, entails hanging the wetsuit in a shaded area out of the sun, as the sun and ultraviolet rays will accelerate the aging of the wetsuit. Similar to the sports pads, the front and back layers of the wetsuit will generally be in contact with each other, or have a minimal amount of space between the layers, forming a "closed" position. Because of this condition, there is an inadequate amount of space for air to flow throughout the wetsuit in order to allow for quicker and more efficient drying of the wetsuit. This condition is exacerbated by the fact that the wetsuit is dried in the shade. Therefore, like the sports pads, the wetsuit may not be completely dried prior to the next use, thereby resulting in an uncomfortable experience, initially, for the wearer.

Therefore, a need exists for an apparatus and method for drying sports pads and apparel in an efficient and effective manner.

SUMMARY

In accordance with an embodiment of the present invention, there is provided a drying apparatus. The drying apparatus comprises at least a first member and a second member, wherein the first and second members are securely interlocked. The first and second members may each further comprise a slot to slide into the corresponding slot of the other member, such that at least a portion of the edge of the slot engages with the other member. The first and second members may each further comprise apertures on either side of the slot to allow for increased air circulation while the drying apparatus is employed. The first and second members may each further comprise protrusions near the base of each member to serve as a stopper to prevent any items to be dried from sliding off the drying apparatus, as well as to serve as feet to provide additional stability for the drying apparatus when it is standing on a surface. At least one of the members may further comprise a hanging means, such as a hook, at the top of the member for hanging the drying apparatus. At least one of the members may further comprise a gripping means, such as a handle, at the top and/or bottom of the drying apparatus.

In accordance with another embodiment of the present invention, there is provided a drying apparatus comprising a first member comprising: a male slot, at least one aperture, a protrusion at the lateral ends near the base of the first member, and a hanging means at the top of the first member. The drying apparatus further comprises a second member positioned such that the first member and second member are substantially perpendicular to each other, the second member comprising: a female slot to slide into the male slot of the first member, such that the first member and the second member are securely interlocked, and at least one aperture.

In accordance with another embodiment, there is provided a method for drying a sports pad, or drying apparel. The method comprises: providing a drying apparatus as described in any one of the embodiments above; assembling the drying apparatus by sliding the slot of the first member into the slot of the second member until at least a portion of the edge of the first slot is engaged with the second member and at least a portion of the edge of the second slot is engaged with the first member; positioning the members such that they form a desired angle with respect to each other; inserting the drying apparatus into the opening of a sports pad or into the opening of a portion of the apparel; and placing the drying apparatus with the sports pad, or the apparel with at least one drying apparatus in at least one portion of the apparel, in a suitable location for drying.

BRIEF DESCRIPTION OF THE DRAWINGS

So the manner in which the above recited features of the present invention may be understood in detail, a more particular description of embodiments of the present invention, briefly summarized above, may be had by reference to embodiments, several of which are illustrated in the appended drawings.

Figures in the appended drawings, like the detailed description, are examples. As such, the Figures and the detailed description are not to be considered limiting, and other equally effective examples are possible and likely. Furthermore, like reference numerals in the Figures indicate like elements, and wherein.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including but not limited to.

DETAILED DESCRIPTION

In the following detailed description, numerous specific details are set forth in order to provide a thorough understanding of embodiments or other examples described herein. In some instances, well-known methods, procedures and components have not been described in detail, so as to not obscure the following description.

Further, the examples disclosed are for exemplary purposes only and other examples may be employed in lieu of, or in combination with, the examples disclosed. It should also be noted the examples presented herein should not be construed as limiting of the scope of embodiments of the present disclosure, as other equally effective examples are possible and likely.

Figure 1:
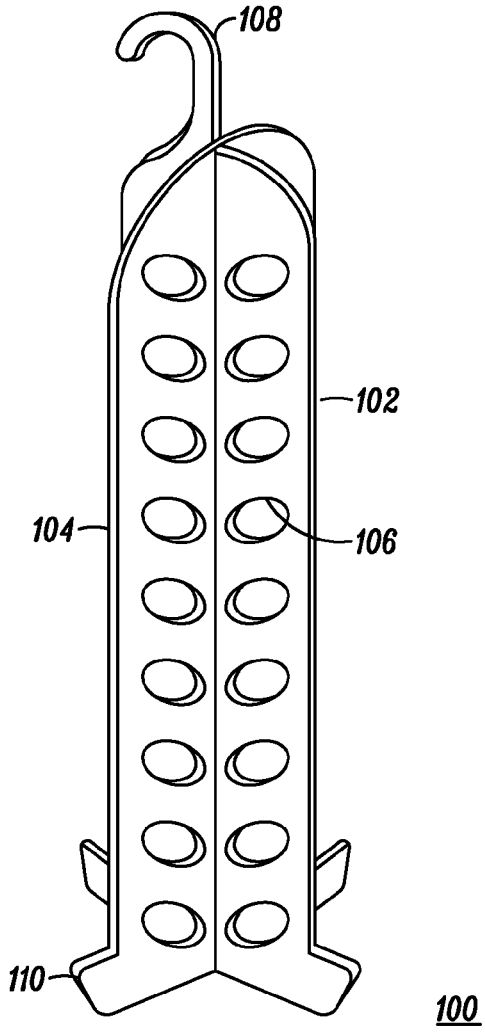
FIG. 1 is a perspective view drawing of a drying apparatus for drying sports pads, or apparel, in accordance with an embodiment of the present invention.

FIG. 1 is a perspective view drawing of a drying apparatus 100, in an assembled position, for drying sports pads or apparel, in accordance with an embodiment of the present invention. The drying apparatus 100 may be inserted in the sports pads or apparel, particularly the sleeves or legs, for drying them, and in turn, may prolong the usability of the sports pads or apparel by holding the pads or layers of the apparel open, thereby keeping the fabric from folding and/or collapsing in on itself. Accordingly, the sports pads or apparel may be dried properly between uses.

The drying apparatus 100 comprises a first member 102 and a second member 104. Although two members are depicted in FIG. 1, any number of members is contemplated. The members 102 and 104 may be constructed of a sturdy, rigid or semi-rigid material. For example, the material of the members 102 and 104 may be plastic, such as polypropylene. Alternatively, the material of the members 102 and 104 may be metal, wood, glass, polystyrene plastic, and the like, or any combination thereof.

Figure 12:
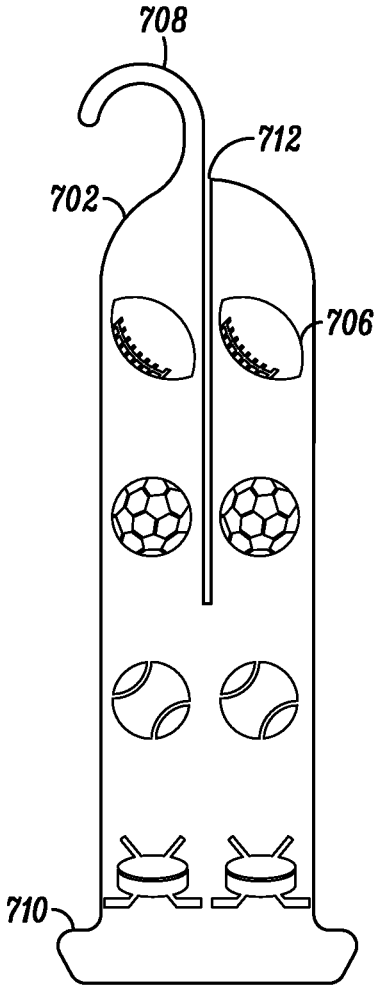
FIG. 12 is a front view drawing of a first member of a drying apparatus in accordance with an embodiment of the present invention.
Figure 13:
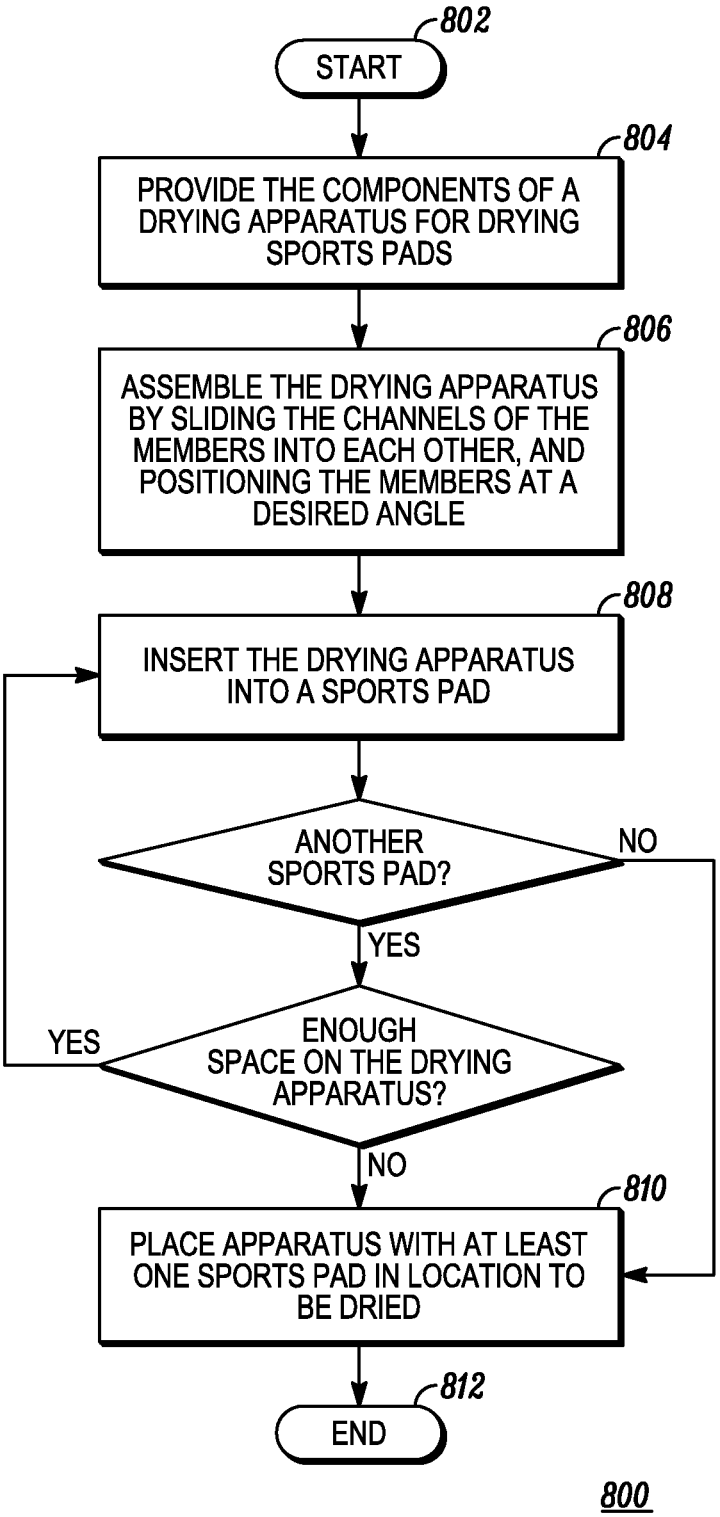
FIG. 13 is a flowchart illustrating an exemplary method for assembling and using the drying apparatus of FIG. 1 in accordance with an embodiment of the present invention.

The members 102 and 104 may comprise apertures 106. The apertures 106 will enable air circulation throughout the inside of the sports pads or apparel, as well as make the drying apparatus 100 lighter and reduce the cost of materials. The apertures 106 may be any shape. For example, the apertures 106 may be any irregular geometric shape or conventional geometrical shape such as circles, ovals, squares and the like, or any combination thereof. Alternatively, the apertures 106 may be shaped to resemble any sporting apparatus, such as a baseball, football, basketball, hockey puck, boxing glove and the like, or any combination thereof, as depicted in FIG. 12 and described hereinafter. The apertures 106 may be any size and in any quantity that may fit on the members 102 and 104. Alternatively, there may be no apertures 106. The apertures 106 may be punched into or cut out of the members 102 and 104, for example with a knife, laser cutter, or the like. Alternatively, the apertures 106 may be precast in the members 102 and 104 by any means known to a person of ordinary skill in the art.

The first member 102 may further comprise a hanging means 108 at the top of the first member 102 for hanging the apparatus 100 when assembled and inserted into at least one sports pad. This will ensure that the majority of the surfaces of the sports pad are in contact with the air only, which will aid in the drying of the sports pads. The hanging means 108 could be a hook, a loop, a hook and loop combination, a string, a magnet, and the like. The size and shape of the hanging means 108 may vary. The hanging means 108 may alternatively be at the top of the second member 104 in addition to or in lieu of being on the first member 102. There may also be no hanging means 108.

The members 102 and 104 may further comprise protrusions 110 at the lateral ends near the base of each member 102 and 104. The protrusions 104 may serve as stoppers to prevent the bottom-most sports pad or apparel from sliding off the drying apparatus 100. The size and shape of the protrusions 110 may vary depending upon the type, and hence the size, of the sports pad or apparel intended to be dried. Additionally, the protrusions 110 may serve as extensions of the bases of the members 102 and 104 such that the drying apparatus 100 may more stably sit on a surface while drying the sports pads or apparel. The protrusions 110 may alternatively be on only one member 102 or 104, or there may be no protrusions 110.

Figure 2:
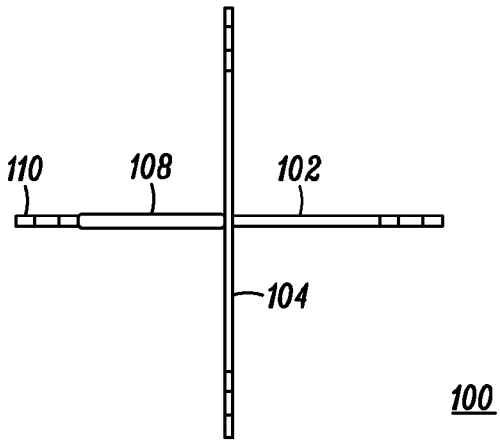
FIG. 2 is a top view drawing of the drying apparatus of FIG. 1.

Referring now to FIG. 2, a top view drawing of the drying apparatus 100 of FIG. 1 is shown. The first member 102 and the second member 104 are assembled such that the first member 102 and the second member 104 are substantially perpendicular to each other. In alternative embodiments, the first member 102 and the second member 104 may be assembled at any other angle capable of providing support for creating space within a sports pad or portions of apparel.

Figure 3:
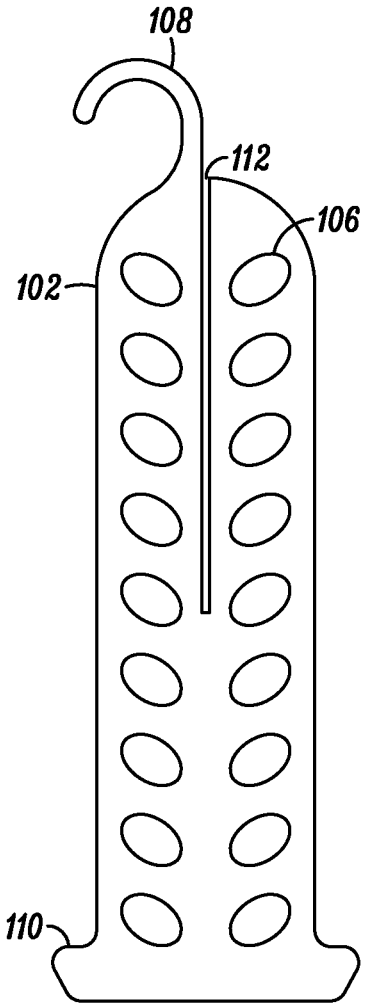
FIG. 3 is a front view drawing of a first member of the drying apparatus of FIG. 1.
Figure 4:
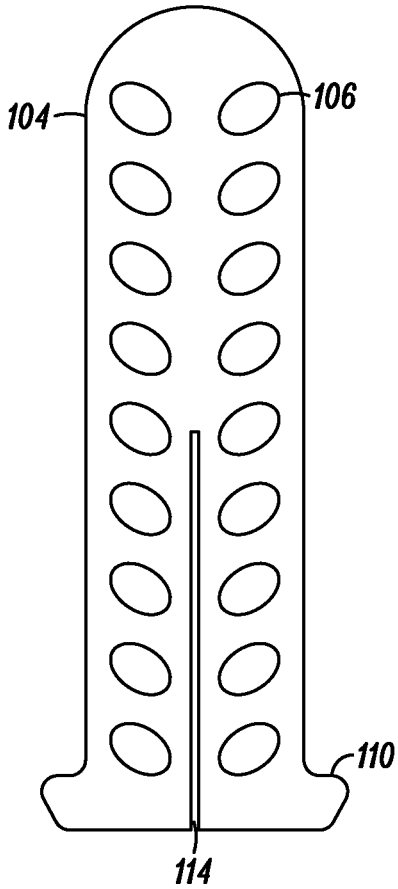
FIG. 4 is a side view drawing of a second member of the drying apparatus of FIG. 1.

FIGS. 3 and 4 depict a front view drawing of the first member 102 and a side view drawing of the second member 104, respectively, of the drying apparatus 100 of FIG. 1 in an unassembled position. The members 102 and 104 may comprise substantially flat surfaces of predefined dimensions and shapes. The members 102 and 104 may be any size and shape that could fit inside a sports pad or portions of apparel. For example, each member 102 and 104 may be mostly rectangular with rounded tops to allow for easy insertion and removal of the drying apparatus 100 into and from the sports pads or portions of apparel. The members 102 and 104 may have uniform width from the top to the base of the members 102 and 104. Alternatively, the members 102 and 104 may be tapered or have steps on the lateral ends such that the widths from the top to the base of the members 102 and 104 are increasing. This will allow sports pads of varying sizes or portions of apparel with varying dimensions to be dried on or with the same drying apparatus 100, with the larger sports pads or wider portions of the apparel being positioned at the base of the drying apparatus 100. The shape of the members 102 and 104 may alternatively be such that the members 102 and 104 are the widest in the center longitudinally and thinner at the top and at the base of the members 102 and 104. The members 102 and 104 may or may not be the same size and/or shape.

The first member 102 and the second member 104 may further comprise a male slot 112 and a female slot 114, respectively. The drying apparatus 100 is assembled by sliding the male slot 112 into the female slot 114, or vice versa, until at least a portion of the edge of the male slot 112 is engaged with the second member 104, and at least a portion of the edge of the female slot 114 is engaged with the first member 102, such that the members 102 and 104 are securely interlocked. The male slot 112 may be open at the top of the first member 102 and generally have a length less than the total length of the first member 102. In one embodiment, this slot 112 may be approximately half the length of the first member 102. The female slot 114 may be open at the bottom of the second member 104 and generally have a length less than the total length of the second member 104. In one embodiment, this slot 114 may be approximately half the length of the second member 104. Alternatively, the slots 112 and 114 may be any length while still maintaining structural integrity of the members 102 and 104 and of the drying apparatus 100 when assembled. While the slots 112 and 114 are generally the same length, they may also be of different lengths.

The width of the slots 112 and 114 will be within minimal tolerances of the thickness of the corresponding members 104 and 102, respectively. For example, the width of the male slot 112 will be substantially the same as the thickness of member 104, and the width of the female slot 114 will be substantially the same as thickness of member 102. Thus, when the members 102 and 104 are interlocked by sliding the slots 112 and 114 into each other and at least a portion of the edge of the slots 112 and 114 are engaged with the corresponding members 104 and 102, a tight, compression fit will be formed between the slots 112 and 114 with the members 104 and 102, respectively. This compression fit will allow the desired angle between the members 102 and 104 to be maintained without much deviation, without the need of any extraneous fins, tabs, protrusions or the like, when a minimal force is applied to the members 102 and 104, such as when the drying apparatus is inserted into a sports pad or portion of apparel.

Figure 5:
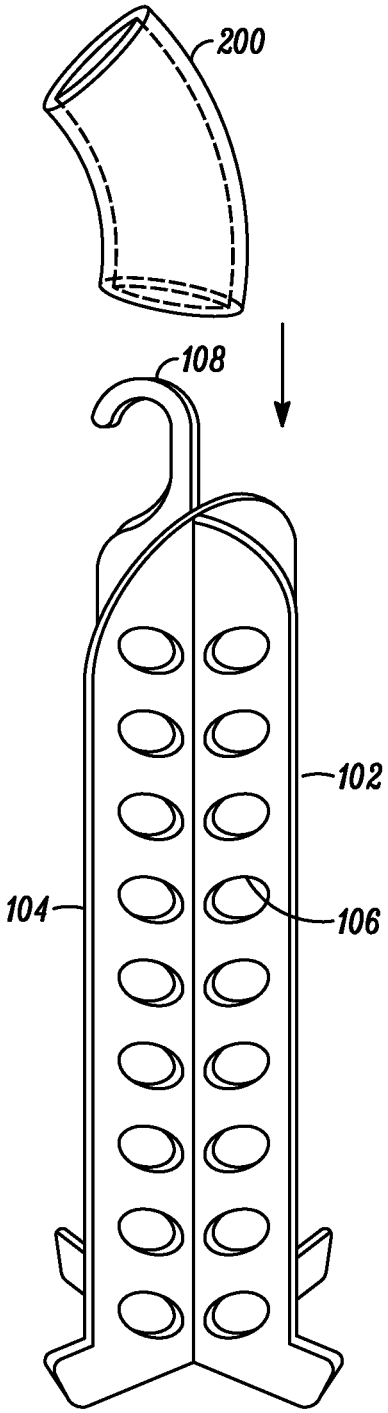
FIG. 5 is a perspective view drawing illustrating a step for using the drying apparatus of FIG. 1 in accordance with an embodiment of the present invention.

FIG. 5 illustrates the step of utilizing the drying apparatus 100 of FIG. 1 for a sports pad 200 in accordance with another embodiment of the present invention. After the drying apparatus 100 is assembled by sliding the slots 112 and 114 into each other, and positioning the members 102 and 104 at a desired angle, the sports pad 200 may be slid onto the drying apparatus 100. Alternatively, the drying apparatus 100 may be slid into the sports pad 200. The tops of the members 102 and 104 may be rounded to allow for easier insertion of the drying apparatus 100 into the sports pad 200. The sports pad 200 may be slid to the base of the drying apparatus 100 such that the sports pad 200 will rest on the protrusions 110. Once the sports pad 200 is in a desired position on the drying apparatus 100, the members 102 and 104 will hold the sports pad 200 in an open position such that air will be able to flow throughout the innards of the sports pad 200, thereby facilitating drying of the sports pad 200. Furthermore, the apertures 106 will allow for better air flow from chamber to chamber created inside the sports pad 200 by the members 102 and 104.

Figure 6:
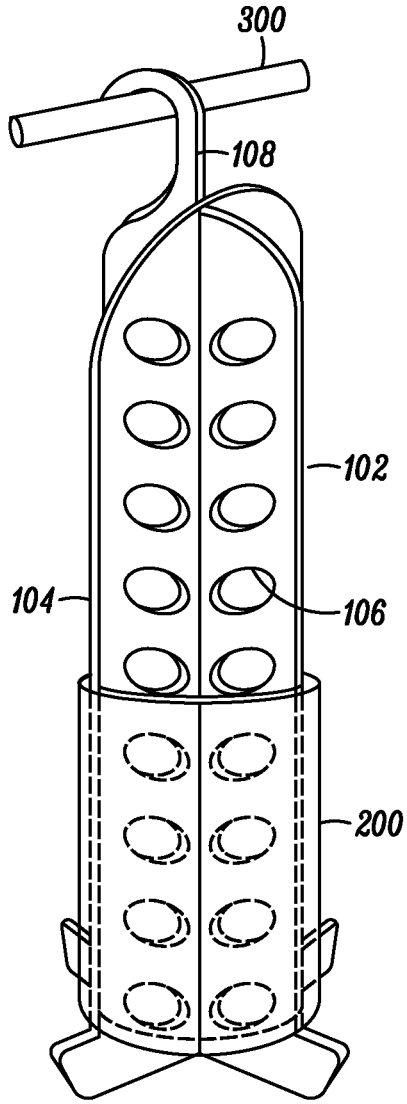
FIG. 6 is a perspective view drawing illustrating a step for using the drying apparatus of FIG. 1 in accordance with an embodiment of the present invention.

FIG. 6 illustrates the step of locating the assembled drying apparatus 100 of FIG. 1, employed with a sports pad 200, to an adequate location for drying of the sports pad 200 in accordance with another embodiment of the present invention. The drying apparatus 100 with the sports pad 200 positioned at the base of the drying apparatus 100 may be hanged on a rod 300 by the hanging means 108 on the top of the first member 102. The drying apparatus 100 may alternatively be hung anywhere suitable for hanging an apparatus, such as a hook, a banister, a chair, and the like. The protrusions 110 may prevent the sports pad 200 from sliding off the drying apparatus 100 when it is being hung. Alternatively, the drying apparatus 100 may stand on a surface, such as a table, the floor, and the like, whereby the protrusions 110 may act as feet to support the drying apparatus 100.

Figure 7:
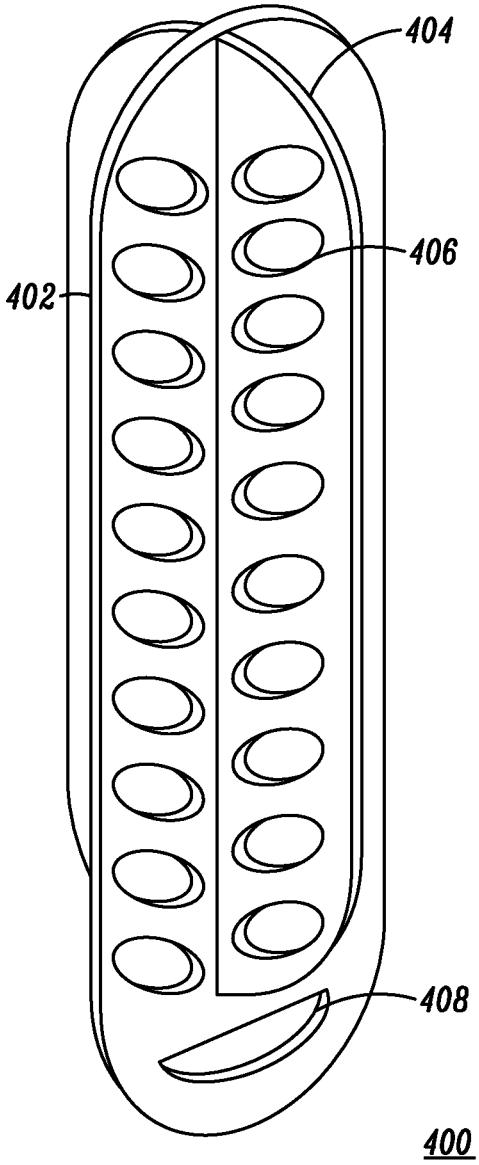
FIG. 7 is a perspective view drawing of a drying apparatus for drying one or more sports pads, or an apparel item, in accordance with an embodiment of the present invention.

FIG. 7 is a perspective view drawing of a drying apparatus 400, in an assembled position, for drying of sports pads or apparel, particularly a wetsuit, in accordance with another embodiment of the present invention. The drying apparatus 400 may be inserted into a sports pad or a portion of the apparel, such as a sleeve or leg, to hold the sports pad or portion of the apparel in an open position. This will allow air to circulate throughout the innards of the sports pad or apparel, thereby facilitating drying of the sports pad or apparel. The drying apparatus 400 comprises a first member 402 and a second member 404. Although two members are depicted in FIG. 7, any number of members is contemplated. The members 402 and 404 may be constructed of a sturdy, rigid or semi-rigid material. For example, the material of the members 402 and 404 may be plastic, such as polypropylene. Alternatively, the material of the members 402 and 404 may be metal, wood, glass, polystyrene plastic, and the like, or any combination thereof.

The members 402 and 404 may comprise apertures 406. The apertures 406 will improve the air circulation throughout the inside of the sports pad or apparel, as well as make the drying apparatus 400 lighter and reduce the cost of materials. The apertures 406 may be any shape. For example, the apertures 406 may be any irregular geometrical shape or conventional geometrical shape such as circles, ovals, squares and the like, or any combination thereof. Alternatively, the apertures 406 may be shaped to resemble any sporting apparatus, such as a baseball, football, basketball, hockey puck, boxing glove and the like, or any combination thereof. The apertures 106 may be any size and in any quantity that may fit on the members 402 and 404. Alternatively, there may be no apertures 406. The apertures 406 may be punched into or cut out of the members 402 and 404, for example with a knife, laser cutter, or the like. Alternatively, the apertures 406 may be precast in the members 402 and 404 by any means known to a person of ordinary skill in the art.

The first member 402 may further comprise a gripping means 408 at the base of the first member 402 for easy insertion and removal of the drying apparatus into the sports pad or the sleeve, leg or other portion of the apparel. The gripping means 408 may be a notch through which the user's hand may fit, or a protrusion or handle onto which the user may grip, or any similar variations. Alternatively, there may be no gripping means 408, and the user may use the apertures 406 to grip the drying apparatus 400 for insertion and removal into and out of the sports pad or the sleeve, leg or other portions of the apparel.

Figure 8:
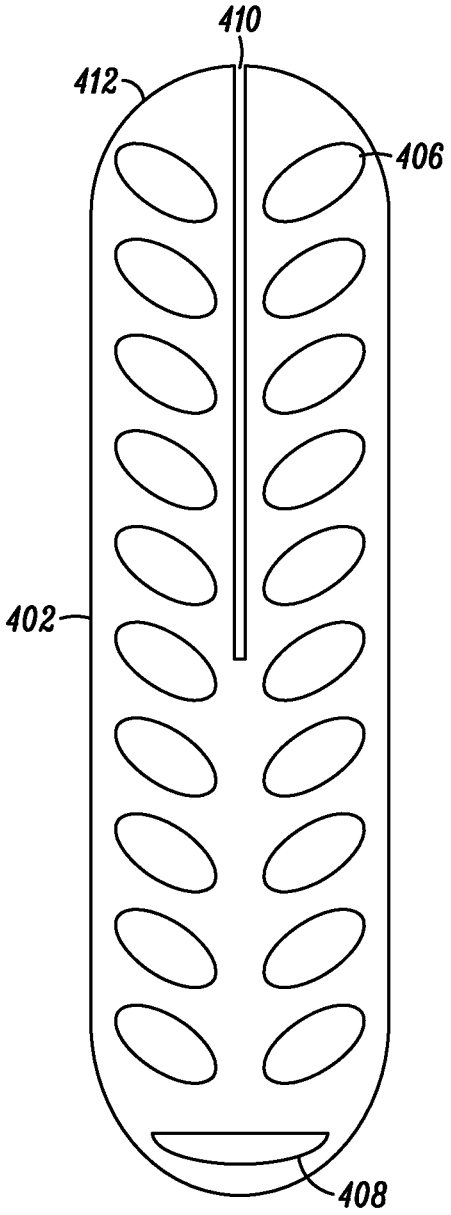
FIG. 8 is a front view drawing of a first member of the drying apparatus of FIG. 7.
Figure 9:
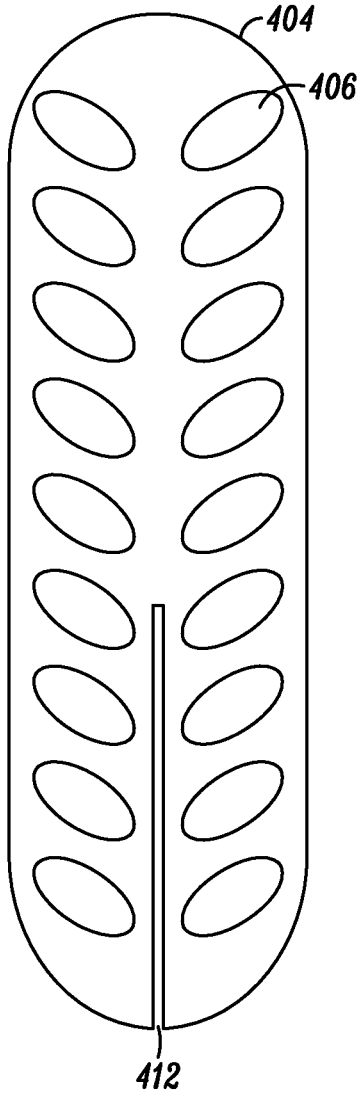
FIG. 9 is a side view drawing of a second member of the drying apparatus of FIG. 7.

FIGS. 8 and 9 depict a front view drawing of the first member 402 and a side view drawing of the second member 404, respectively, of the drying apparatus 400 of FIG. 7. The members 402 and 404 may comprise substantially flat surfaces of predefined dimensions and shapes. The members 402 and 404 may be any size and shape that could fit inside the sports pad or the sleeve, leg or other portions of the apparel. For example, each member 402 and 404 may be mostly rectangular with rounded tops and bottoms to allow for easy insertion and removal of the drying apparatus 400 into and out of the sports pad or portions of the apparel. The width and length of the members 402 and 404 may be such that they match the general dimensions of the sports pad or portions of the apparel, from as thin as the wrist to as thick as the upper thigh, with a length that may be as long as an entire arm or leg. The members 402 and 404 may also be small enough to place inside, for example, a wet shoe, or large enough to fit the torso of the wetsuit. The dimensions of the members 402 and 404 may also range to accommodate sports pads and apparel of varying sizes, i.e. for children and adults.

The members 402 and 404 may have uniform width from the top to the base of the members 402 and 404. Alternatively, the members 402 and 404 may be tapered such that the widths from the top to the base of the members 402 and 404, or vice versa, are increasing. The members 402 and 404 may alternatively be shaped such that when they are assembled together to form the drying apparatus 400, the drying apparatus 400 will match the contours of the sports pad or portions of the apparel, such as the sleeve or leg. This will more effectively hold the sports pad or the portion of the apparel in an open position to allow air to flow throughout the sports pad or apparel. The members 402 and 404 may or may not be the same size and/or shape.

The first member 402 and the second member 404 may further comprise a male slot 410 and a female slot 412, respectively. The drying apparatus 400 is assembled by sliding the male slot 410 into the female slot 412, or vice versa, until at least a portion of the edge of the male slot 410, is engaged with the second member 404, and at least a portion of the edge of the female slot 412 is engaged with the first member 402, such that the members 402 and 404 are securely interlocked. The male slot 410 may be open at the top of the first member 402 and generally have a length less than the total length of the first member 402. In one embodiment, this slot 410 may be approximately half the length of the first member 402. The female slot 410 may be open at the bottom of the second member 404 and generally have a length less than the total length of the second member 402. In one embodiment, this slot 412 may be approximately half the length of the second member 404. Alternatively, the slots 410 and 412 may be any length while still maintaining structural integrity of the members 402 and 404 and of the drying apparatus 400 when assembled. While the slots 410 and 412 are generally the same length, they may also be of different lengths.

The width of the slots 410 and 412 will be within minimal tolerances of the thickness of the corresponding members 404 and 402, respectively. For example, the width of the male slot 410 will be substantially the same as the thickness of member 404, and the width of the female slot 412 will be substantially the same as the thickness of member 402. Thus, when the members 402 and 404 are interlocked by sliding the slots 410 and 412 into each other and at least a portion of the edge of the slots 410 and 412 are engaged with the corresponding members 404 and 402, a tight, compression fit will be formed between the slots 410 and 412 with the members 404 and 402, respectively. This compression fit will allow the desired angle between the members 402 and 404 to be maintained without much deviation, without the need of any extraneous fins, tabs, protrusions or the like, when a minimal force is applied to the members 402 and 404, such as when the drying apparatus is inserted into a sports pad or portion of apparel.

Figure 10:
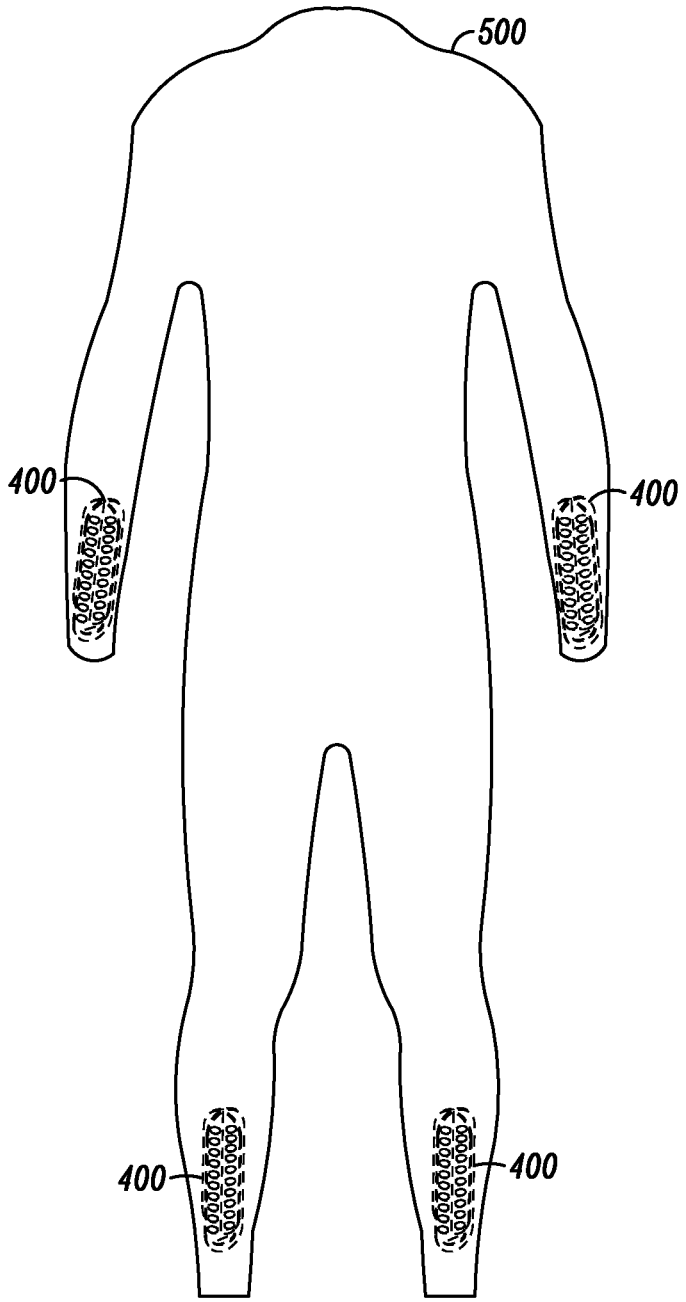
FIG. 10 is a front view drawing illustrating a step for using the drying apparatus of FIG. 7 in accordance with an embodiment of the present invention.

FIG. 10 illustrates the drying apparatus 400 of FIG. 7 inserted into the sleeves and legs of a wetsuit 500. Although not shown, the drying apparatus 400 may be inserted into other portions of a wetsuit, or any other apparel, such as a hood or booties. The drying apparatus 400 will hold the sleeves and legs in an open position such that air will be able to flow throughout the wetsuit 500, facilitating quicker drying. The drying apparatus 400 may be inserted from the outside of the wetsuit 500 through the hand and foot openings, or alternatively, from the inside of the wetsuit 500 by the shoulders and thighs. The wetsuit 500 may be hung with at least one drying apparatus 400 in at least one sleeve or leg of the wetsuit 500.

Figure 11:
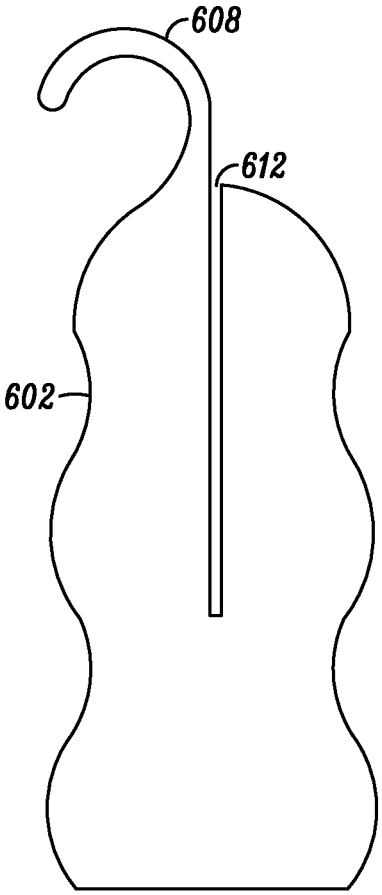
FIG. 11 is a front view drawing of a first member of a drying apparatus in accordance with an embodiment of the present invention.

FIG. 11 is a front view drawing of one member 602 according to another embodiment of the present invention. The member 602 is similar to the members 102 and 402 of FIGS. 3 and 8, respectively. The member 602 may comprise a sturdy, rigid or semi-rigid material. The member 602 may further comprise a hanging means 608, such as a hook, at the top of the member 602, and a slot 612. The slot 612 may span any length of the member 602, and may have a width within a minimal tolerance of the thickness of a female member not shown. While member 602 is shown without apertures, it is understood that member 602 may further comprise at least one aperture in any shape or size.

The shape of member 602 may be any shape and outline, and does not have to be restricted to a generally rectangular shape, as depicted in members 102 and 402. The shape of member 602 may be completely aesthetic with no functional purpose. The shape of member 602 may be functional, where the variation in width may allow the drying apparatus, when assembled with member 602 and a female member, to engage with sports pads of various sizes or portions of apparel with varying dimensions.

FIG. 12 is a front view drawing of one member 702 in accordance with another embodiment of the present invention. The member 702 may be the same as member 102 depicted in FIG. 3, the difference being the shape of the apertures 706. The apertures 706 may be shaped to resemble any sporting apparatus or equipment, such as a baseball, football, basketball, hockey puck, boxing glove, and the like, or any combination thereof. The apertures 706 may alternatively be any conventional geometrical shape such as circles, ovals, squares and the like, or any combination thereof. The apertures 706 may be any size and in any quantity that may fit on the member 702. Alternatively, there may be no apertures 406. The apertures 406 may be punched into or cut out of the member 702, for example with a knife, laser cutter, or the like. Alternatively, the apertures 706 may be precast in the member 702 by any means known to a person of ordinary skill in the art.

FIG. 14 is a flowchart illustrating an exemplary method 800 for assembling and using a drying apparatus. The drying apparatus 100 of FIG. 1 is used as an example. However, the drying apparatus may be any variation thereof.

The method 800 begins at step 802. At step 804, the first member 102 and the second member 104 are provided. At step 806, the drying apparatus 100 is assembled by sliding the female slot 114 of the second member 104 into the male slot 112 of the first member 102 until at least a portion of the edge of the female slot 114 is engaged with the first member 102, and at least a portion of the edge of the male slot 112 is engaged with the second member 104, such that the first member 102 and second member 104 are securely interlocked. The members 102 and 104 are then positioned at an optimal angle in relation to each other to fit the sports pad intended to be dried. At step 808, the drying apparatus 100 may be inserted into the opening of the sports pad. The sports pad may be pushed over or slid down the length of the drying apparatus 100 until the hanging means 108 is exposed and/or the bottom of the sports pad rests on the protrusions 110. Alternatively, the drying apparatus 1010 may be inserted into the sports pad. Step 808 may be repeated until all sports pads intended to be dried are on the drying apparatus 100, or the drying apparatus 100 has no more space for additional sports pads. At step 810, the drying apparatus 100 with at least one sports pad may be placed and stood up on a surface, and/or hung from the hanging means 108, or some other configuration to enable appropriate air flow. The drying apparatus 100 may be hung from the hanging means 108 in front of a fan to increase the air circulation and thus faster drying. The method ends at step 812.

The method 800 may be adjusted to apply the drying apparatus to an apparel item, such as a wetsuit. The drying apparatus 400 of FIG. 7 will be used as an example. Again, the method 800 begins at step 802. At step 804, the first member 402 and the second member 404 are provided. At step 806, the drying apparatus is assembled by sliding the female slot 412 of the second member 404 into the male slot 410 of the first member 402 until at least a portion of the edge of the female slot 412 is engaged with the first member 402 and at least a portion of the male slot 410 is engaged with the second member 404, such that the first member 402 and second member 404 are securely interlocked. The members 402 and 404 are then positioned at an optimal angle in relation to each other to fit a sleeve, leg or other portion of the apparel to be dried. At step 808, the drying apparatus 400 may be inserted into the opening of the sleeve, leg or other portion of the apparel to be dried. This may be done by gripping the gripping means 408 and pushing the drying apparatus 400 into the sleeve, leg or other portion, either from the inside of the apparel or from the outside of the apparel via the openings of the portions of the apparel. Steps 804 through 808 may be repeated until all the sleeves, legs and other portions desired to be maintained in an open position have a drying apparatus 400 inserted into them. At step 810, the apparel with at least one drying apparatus 400 inside at least one portion of the apparel may be placed in a location to be dried, for example, hung in a shaded area. The method ends at step 812.

While the foregoing is directed to embodiments of the invention, other and further embodiments of the invention may be devised without departing from the basic scope thereof. In particular, it should be appreciated that any element of any embodiments disclosed herein may be combined with any other elements from any other embodiments disclosed herein, in accordance with yet further embodiments of the present invention.

What is claimed is:

1. A drying apparatus comprising:
- a first member comprising:
  - a body;
  - a male slot formed in the body;
  - at least one aperture formed in the body that enables air circulation to dry apparel disposed on the drying apparatus;
  - a protrusion at each of the lateral ends near a base of the first member; and
  - a hanging hook at a top of the first member; and
- a second member positioned such that the first member and second member are substantially perpendicular to each other, the second member comprising:
  - a body;
  - a female slot formed in the body to slide into the male slot of the first member such that the first member and the second member are securely interlocked; and
  - at least one aperture formed in the body that enables air circulation to dry apparel disposed on the drying apparatus.

2. The drying apparatus of claim 1, wherein the width of each slot is substantially the same as the thickness of the at least one other member.

3. The drying apparatus of claim 1, wherein each of the first and second members is any shape.

4. The drying apparatus of claim 1, wherein the at least one aperture of each of the first and second members is any size as limited by the size of the at least one member.

5. The drying apparatus of claim 1, wherein the at least one aperture of each of the first and second members is any irregular geometrical shape.

6. The drying apparatus of claim 1, wherein the at least one aperture of each of the first and second members is any conventional geometrical shape.

7. The drying apparatus of claim 1, wherein at least one of the members comprises a gripping means at a top or bottom of the member.

8. The drying apparatus of claim 1, wherein the body of the first member and the body of the second member are substantially the same dimensions.

9. A method of drying sports pads or apparel comprising:
- providing a drying apparatus comprising:
  - a first member comprising a body, a male slot formed in the body, at least one aperture formed in the body that enables air circulation to dry apparel disposed on the drying apparatus, and a hanging hook disposed on top of the body; and
  - a second member comprising a body, a female slot formed in the body, and at least one aperture formed in the body that enables air circulation to dry apparel disposed on the drying apparatus;
- assembling the drying apparatus by sliding the female slot of the second member into the male slot of the first member until a portion of an edge of the female slot is engaged with the first member and a portion of an edge of the male slot is engaged with the second member, such that the first member and second member are securely interlocked;

positioning the first member and second member such that the first member and second member are at a desired angle to suitably fit a shape of at least one sports pad or a portion of an apparel; and inserting the drying apparatus into an opening of the at least one sports pad or an opening of the portion of the apparel, and placing the at least one sports pad or apparel item with the drying apparatus in a location for drying.

10. The method of drying sports pads or apparel of claim 9, wherein at least one of the members of the drying apparatus further comprises a gripping means at the top or bottom of the member to further the step of inserting the drying apparatus into the opening of the at least one sports pad or the opening of the portion of the apparel.

11. The method of drying sports pads or apparel of claim 9, further comprising standing the drying apparatus on its base on a surface such that the majority of the surface of the at least one sports pad or apparel will be in contact with the air only.

12. The method of drying sports pads or apparel of claim 9, wherein at least one of the members of the drying apparatus further comprises at least one aperture to further the step of drying the sports pads.

13. The method of drying sports pads or apparel of claim 9, wherein at least one of the members further comprises protrusions at each of the lateral ends of the base of that member.

14. The method of drying sports pads or apparel of claim 9, further comprising hanging the drying apparatus by the hanging means hook from any location capable of receiving the hook.

15. The method of drying sports pads or apparel of claim 9, wherein the body of the first member and the body of the second member are substantially the same dimensions.

* * * * *